US006311583B1

(12) United States Patent
Izumisawa

(10) Patent No.: US 6,311,583 B1
(45) Date of Patent: Nov. 6, 2001

(54) RATCHET WRENCH WITH PIVOTABLE HEAD

(75) Inventor: Osamu Izumisawa, Tokyo (JP)

(73) Assignee: S. P. Air Kabusiki Kaisha, Nagano Pref. (JP)

( * ) Notice: Subject to any disclaimer, the term of this patent is extended or adjusted under 35 U.S.C. 154(b) by 0 days.

(21) Appl. No.: 09/549,122

(22) Filed: Apr. 13, 2000

(51) Int. Cl.[7] ..... B25B 21/00
(52) U.S. Cl. ..... 81/57.13; 81/57.26; 81/177.8
(58) Field of Search ..... 81/57.13, 57.26, 81/58, 177.7, 177.8, 177.9

(56) References Cited

U.S. PATENT DOCUMENTS

| | | | |
|---|---|---|---|
| D. 334,124 | 3/1993 | Izumisawa . | |
| D. 334,125 | 3/1993 | Izumisawa . | |
| 928,375 | 7/1909 | Frick . | |
| 978,395 | 12/1910 | Peters . | |
| 1,000,878 | 8/1911 | Allen . | |
| 1,019,825 | 3/1912 | Mossberg . | |
| 1,080,121 | 12/1913 | Oriol . | |
| 1,109,032 | 9/1914 | Bersted . | |
| 1,178,287 | 4/1916 | Anderson . | |
| 1,198,822 | 9/1916 | Capel . | |
| 1,265,535 | 5/1918 | Shannon . | |
| 1,324,258 | 12/1919 | Lewis . | |
| 1,325,407 | 12/1919 | Morgan . | |
| 1,568,442 | 1/1926 | Carver . | |
| 1,840,685 | 1/1932 | Witherup . | |
| 1,975,695 | 10/1934 | Lund . | |
| 2,073,903 | 3/1937 | O'Neil . | |
| 2,235,434 | 3/1941 | Kincaid . | |
| 2,268,802 | 1/1942 | Coffman . | |
| 2,498,465 | 2/1950 | Thomas . | |
| 2,499,569 | 3/1950 | Cooley . | |
| 2,501,217 | 3/1950 | Hawn . | |
| 2,669,147 | 2/1954 | Koenig . | |
| 2,705,897 | 4/1955 | Kentish . | |
| 2,791,142 | 5/1957 | Lyon . | |
| 2,881,884 | 4/1959 | Amtsberg . | |
| 2,921,773 | 1/1960 | Hoelzer . | |
| 3,256,758 | 6/1966 | Medesha . | |
| 3,605,914 | 9/1971 | Kramer . | |
| 3,661,217 | 5/1972 | Maurer . | |
| 3,779,107 | * 12/1973 | Avery | 81/177.8 |
| 4,075,913 | 2/1978 | Tye . | |
| 4,171,651 | 10/1979 | Dacunto . | |
| 4,287,795 | 9/1981 | Curtiss . | |
| 4,296,654 | 10/1981 | Mercer . | |
| 4,299,145 | 11/1981 | Rautio et al. . | |
| 4,346,630 | 8/1982 | Hanson . | |
| 4,406,186 | 9/1983 | Gummow . | |
| 4,530,261 | 7/1985 | Ventura . | |
| 4,530,262 | 7/1985 | Pownall . | |
| 4,552,544 | 11/1985 | Beckman et al. . | |
| 4,680,994 | 7/1987 | Singleton . | |
| 4,747,328 | 5/1988 | Howard . | |
| 4,748,872 | 6/1988 | Brown . | |
| 4,791,836 | 12/1988 | D'Haem et al. . | |

(List continued on next page.)

*Primary Examiner*—Joseph J. Hail, III
*Assistant Examiner*—David B Thomas
(74) *Attorney, Agent, or Firm*—Senniger, Powers, Leavitt & Roedel

(57) ABSTRACT

A power ratchet wrench has a handle for gripping and holding the wrench and a head pivotally connected to the handle for pivoting movement relative to the handle about a pivot axis. A locking mechanism comprising a pivot assembly pivotally connects the head to the handle. The locking mechanism is configured to permit selective angular positioning of the head relative to the handle on the pivot axis and is operable between an adjusting mode in which the head is angularly positionable relative to the handle and a locking mode in which the head is locked in an angular orientation relative to the handle. The locking mechanism is rotatable about an axis transverse to the handle between the adjusting mode and locking mode of the locking mechanism.

10 Claims, 4 Drawing Sheets

U.S. PATENT DOCUMENTS

| | | | |
|---|---|---|---|
| 4,794,829 | | 1/1989 | Mesenhoeller . |
| 4,821,611 | | 4/1989 | Izumisawa . |
| 4,854,197 | | 8/1989 | Walton . |
| 4,856,385 | | 8/1989 | Ogilvie et al. . |
| 4,901,608 | | 2/1990 | Shieh . |
| 4,974,475 | | 12/1990 | Lord et al. . |
| 4,987,803 | | 1/1991 | Chern . |
| 4,993,288 | | 2/1991 | Anderson et al. . |
| 5,419,221 | | 5/1995 | Cole . |
| 5,784,934 | | 7/1998 | Izumisawa . |
| 6,053,076 | * | 4/2000 | Barnes ..... 81/60 |

* cited by examiner 117
103
105
109
125
127
129
131
133
135
67
69
D1
D2
225
227
229
231
203

RATCHET WRENCH WITH PIVOTABLE HEAD

BACKGROUND OF THE INVENTION

This invention relates generally to wrenches, and more specifically to a ratchet wrench having a pivotable head.

Wrenches having a straight fixed head are difficult to use in tight spaces which arc often readily accessible by wrenches having a head located at an angled position relative to a body of the wrench. Many currently available wrenches which have an adjustable head typically require the head to be moved away from the body to adjust the position of the head relative to the body. This is inconvenient since it generally requires two hands to adjust the head and requires the wrench to be moved away from the fastener the wrench is being used to loosen or tighten.

To this end, co-owned U.S. Pat. No. 5,784,934 (Izumisawa) discloses a ratchet wrench with pivotable head in which a pin is received in respective openings of connecting ends of the head and handle of the wrench to interconnect the head and handle. The pin is selectively movable laterally within the openings between a first position in which the head is pivotable relative to the handle to a desired angular orientation and a second position in which the head is fixed at the desired angular orientation relative to the handle. Portions of the pin have splines so that in the second position of the pin, the splines interengage corresponding splines in the openings of the head and handle connecting ends to lock the head against pivoting movement relative to the handle. While this design works well, the relative sizing of the splines of the pin and the connecting ends of the head and handle necessary to allow interengagement of the splines results in a small amount of rotational free-play in the wrench.

There is a need, therefore, for a ratchet wrench with pivotable head in which the head is more positively locked in a desired angular orientation relative to the handle.

SUMMARY OF THE INVENTION

Among the several objects of the invention may be noted the provision of a ratchet wrench which can access fasteners in hard to reach locations for loosening or tightening; the provision of such a ratchet wrench which is reconfigured by pivoting a head relative to a handle without translational movement between the head and handle; the provision of such a ratchet wrench which inhibits free-play between the head and handle once the head is locked in a desired angular orientation relative to the handle; the provision of such a wrench which can transmit power through the pivot between the head and handle; the provision of such a ratchet wrench which is of relatively simple and sturdy construction; the provision of such a ratchet wrench which is reliable; and the provision of such a ratchet wrench which is relatively light weight.

Generally, a ratchet wrench of the present invention comprises a handle for gripping and holding the wrench. A head is pivotally connected to the handle for pivoting movement relative to the handle about a pivot axis. A locking mechanism comprising a pivot assembly pivotally connects the head to the handle. The locking mechanism is configured to permit selective angular positioning of the head relative to the handle on the pivot axis and is operable between an adjusting mode in which the head is angularly positionable relative to the handle and a locking mode in which the head is locked in an angular orientation relative to the handle. The locking mechanism is rotatable about an axis transverse to the handle between the adjusting mode and locking mode of the locking mechanism.

In another embodiment, a power ratchet wrench of the present invention comprises a handle for gripping and holding the wrench and a head pivotally connected to the handle for pivoting movement relative to the handle about a pivot axis. The head and handle have respective openings generally in registry with each other in coaxial relationship on the pivot axis. A locking mechanism comprising a pivot assembly pivotally connects the head to the handle. The locking mechanism is configured to permit selective angular positioning of the head relative to the handle on the pivot axis and is operable between an adjusting mode in which the head is angularly positionable relative to the handle and a locking mode in which the head is locked in an angular orientation relative to the handle. The pivot assembly comprises a pivot pin extending transversely through the openings of the handle and head and defining the pivot axis. The pivot pin is rotatable on the pivot axis between the adjusting and locking modes of the locking mechanism. The locking mechanism further comprises a slot in one of the handle and head extending radially outward from the respective opening of said one of the handle and head. A plurality of slots in the other of the handle and head extend generally radially outward from the respective opening of said other of the handle and head and correspond generally to the angular positions at which the head may be oriented relative to the handle. The plurality of slots are arranged for sequential registry with the slot extending from the opening of said one of the handle and head upon pivoting movement of the head relative to the handle. A locking member is disposed in the openings of the handle and head and is movable relative to the head and handle in response to rotation of the pivot pin between the adjusting mode and locking mode such that in the locking mode of the locking mechanism the locking member seats in the slot of the opening of said one of the handle and head and in a respective one of the plurality of slots of the opening of said other of the handle and head to secure the head against pivoting movement relative to the handle. In the adjusting mode the locking member is away from the plurality of slots of the opening of the other of the handle and head to permit pivoting movement of the head on the pivot axis relative to the handle. A motor is provided for powering the ratchet wrench.

Other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENT

Figure 1:
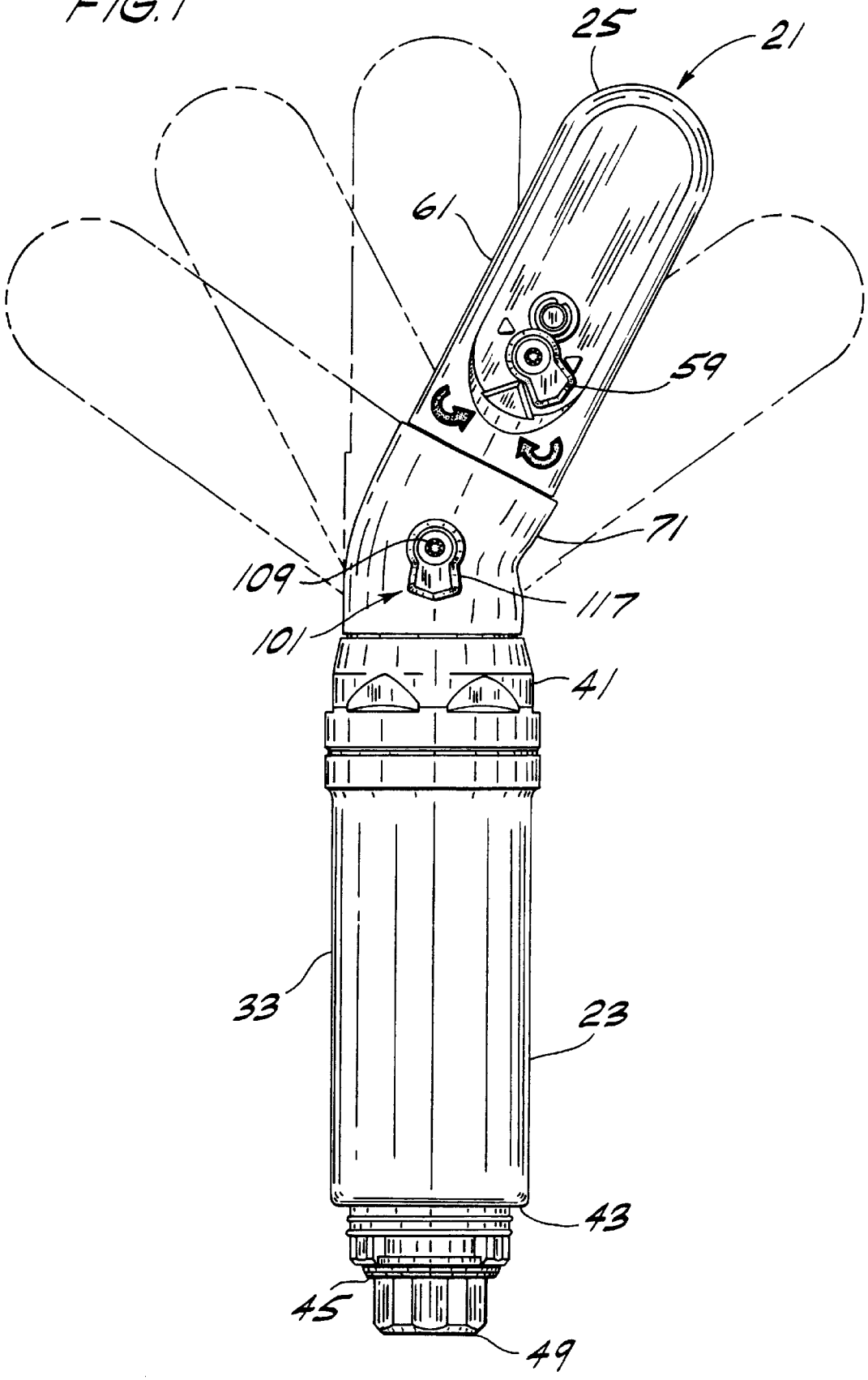
FIG. 1 is a rear view of a ratchet wrench of this invention with a head of the wrench shown in phantom in various pivoted positions relative to a handle of the wrench.
Figure 2:
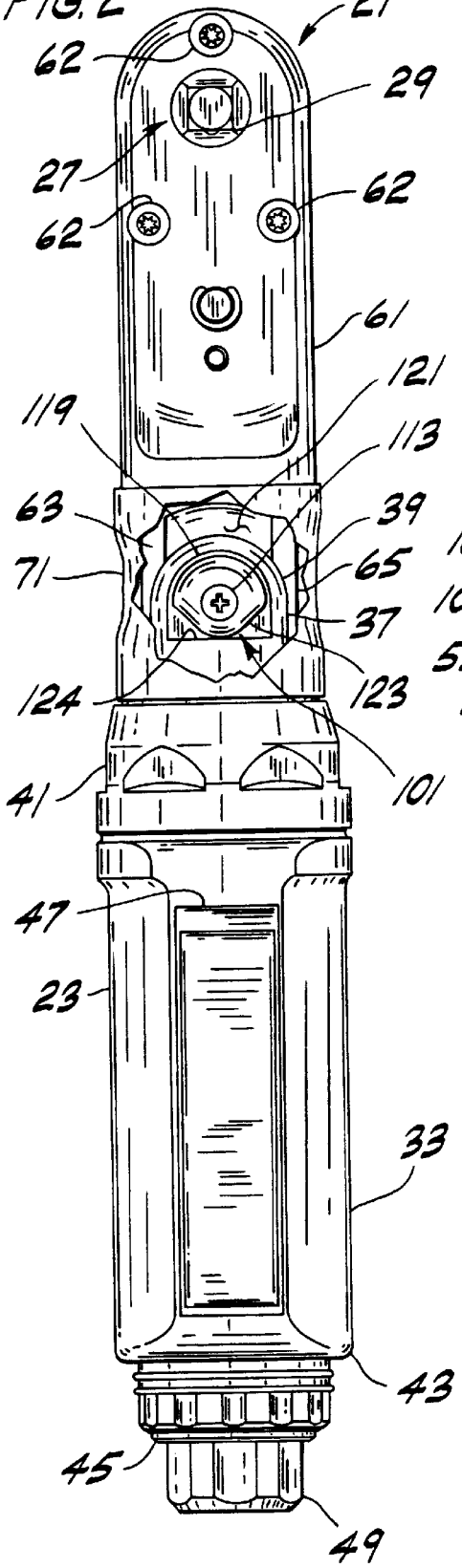
FIG. 2 is a front view of the ratchet wrench of FIG. 1 with a portion of the wrench broken away to reveal internal construction.
Figure 3:
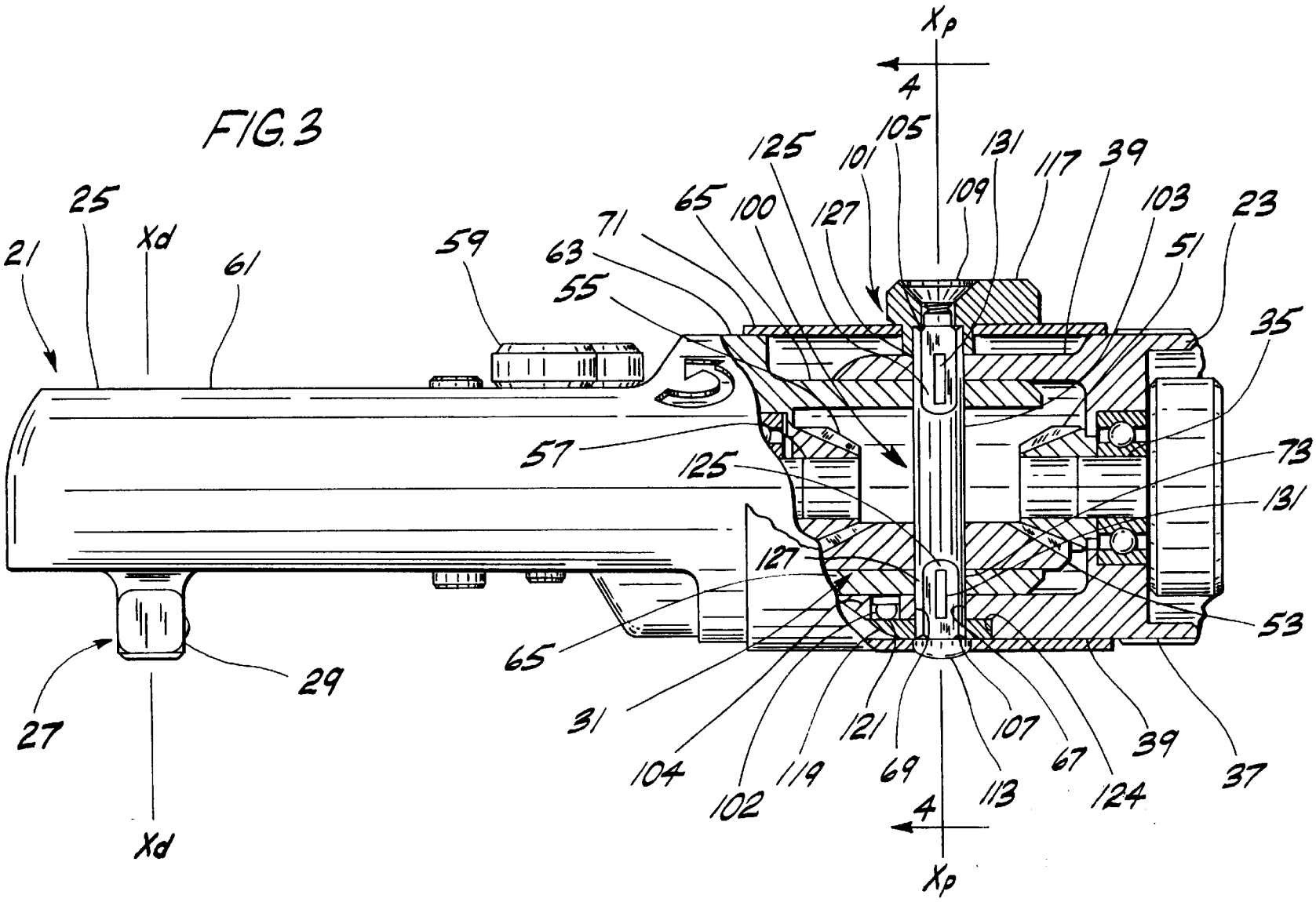
FIG. 3 is an enlarged, fragmentary side view of the ratchet wrench of FIG. 1 shown in partial section.

Referring now to the drawings, and in particular to FIGS. 1–3, a power driven ratchet wrench of the present invention is generally indicated at 21. The ratchet wrench 21 includes a handle 23 for gripping and holding the wrench and a head 25 having a ratchet mechanism 27 including a drive shaft 29 capable of powered rotation about its axis Xd (FIG. 3). The handle 23 and head 25 are pivotally interconnected by a locking mechanism of the present invention, generally indicated at 101, to permit selective angular adjustment of the head relative to the handle as described later herein. A motor (not shown) is disposed in the handle 23 for driving a transmission, generally indicated at 31 in FIG. 3, which in turn drives the ratchet mechanism 27. In the illustrated embodiment, the motor in the handle 23 is pneumatically driven by pressurized air from an external source (not shown) of pressurized air. However, the principles of the present invention are generally applicable to a power ratchet wrench driven by an electric motor or other suitable system for driving the motor. The wrench 21 may also be manually driven instead of power driven without departing from the scope of this invention.

The handle 23 has a generally cylindrical housing 33 that houses the motor and a drive member 35 drivingly connecting the motor to the transmission 31 for driving the transmission. The handle 23 has a connecting end 37 disposed axially adjacent to the head 25 for use in pivotally connecting the head to the handle. In the illustrated embodiment, the connecting end 37 of the handle 23 comprises a pair of arms 39 extending axially outward relative to the cylindrical housing 33 in generally parallel, laterally spaced relationship with each other. A hex shaped coupling 41 is threadably secured to the housing 33 for coupling the arms 39 to the handle 23. It is to be understood, however, that the arms 39 may instead be integrally formed with the housing 33, thus omitting the need for the coupling 41.

An opposite end 43 of the handle 23 (i.e., the lower end in the illustrated embodiment) includes an air inlet 45 for supplying pressurized air from the external pneumatic power source to the pneumatically actuated motor in the housing 33 of the handle. The air inlet 45 comprises an air inlet connector 47 threadably engaged in the housing 33 of the handle 23 for connecting the wrench 21 to the source of pressurized air. A lever 49 is pivotally mounted on the housing 33 in operative connection with a valve (not shown) in the housing so that the lever is selectively movable between an inoperative position away from the handle in which air is sealed by the valve against flow into the wrench 21 and an operative position adjacent the handle 23 in which the valve is open to permit the flow of air into the housing to drive the motor.

With particular reference to FIG. 3, the transmission 31 is constructed to transmit power from the motor to the ratchet mechanism 27. The transmission 31 of the illustrated embodiment includes three bevel gears 51, 53, 55. The first bevel gear 51 is mounted on the drive member 35 extending from the motor for conjoint rotation about the rotation axis of the drive member. The second bevel gear 53 is oriented transverse to the first gear 51 and is interengaged with the first gear for being driven by the first gear about a rotation axis of the second gear transverse to the rotation axis of the drive member. The third bevel gear 55 is connected to the ratchet mechanism 27 by a ratchet drive member 57. This third gear 55 is interengaged with the second gear 53 in opposed, parallel, coaxial relationship with the first gear 51 for being driven by the second gear about the rotation axis of the drive member to drive the ratchet mechanism 27 via the ratchet drive member 57. Thus, the second gear 53 transmits power from the first gear 51 to the third gear 55 for driving the ratchet mechanism 27.

The ratchet mechanism 27 is partially disposed in the head 25 and is a conventional ratchet system which includes the drive shaft 29 and a ratchet direction selector 59. The ratchet direction selector 59 is selectively positionable for operating the drive shaft 29 to drive a socket (not shown) connected thereto in a clockwise or counterclockwise direction about the axis Xd of the drive shaft. The drive shaft 29 extends laterally outward from the head 25 and is adapted to releasably hold the socket for conjoint rotation of the socket with the drive shaft so as to tighten or loosen a fastener such as a nut or bolt (not shown). The head 25 has a hollow housing 61 that houses the ratchet mechanism 27 and ratchet drive member 57. The head 25 is of two-piece construction connected together by suitable fasteners 62 (FIG. 2). A connecting end 63 of the head 25 comprises a pair of connecting arms 65 extending axially outward from the housing 61 in generally parallel, laterally spaced relationship with each other. The lateral spacing between the connecting arms 65 of the head 25 is slightly less than that of the connecting arms 39 of the handle 23 so that the connecting arms of the head are insertable between the connecting arms of the handle generally in side-by-side engagement therewith.

Figure 4:
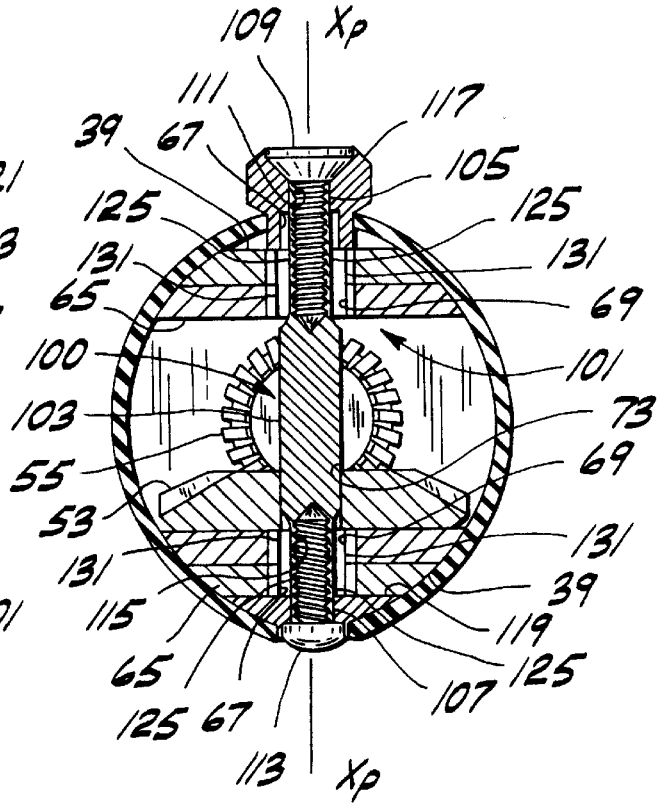
FIG. 4 is a section taken in the plane including line 4—4 of FIG. 3.
Figures 5A, 5B, 5C, 6A, 6B, 6C:
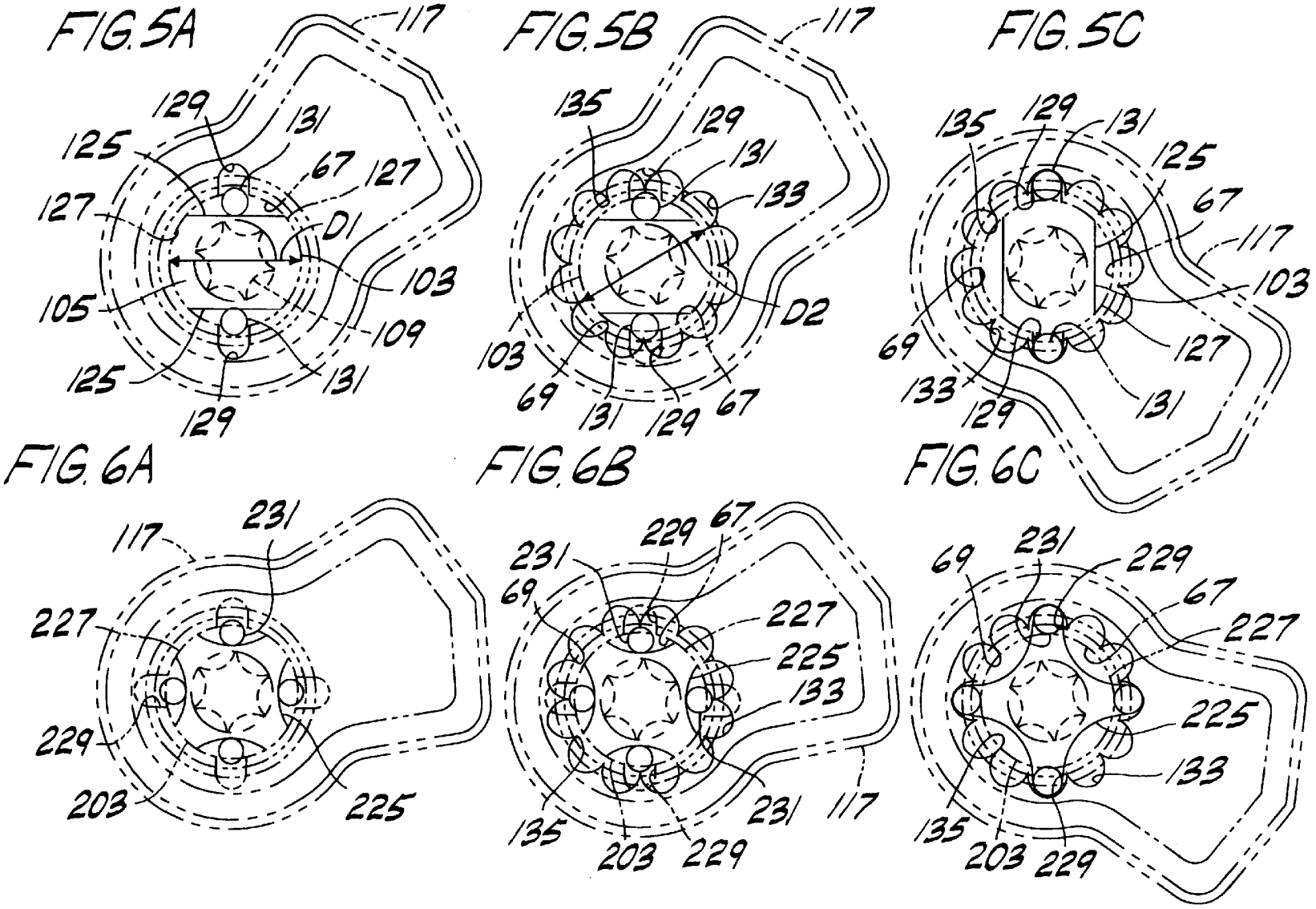
FIGS. 5A–C are schematic views of a pivot assembly of the ratchet wrench of FIG. 1, with portions of the assembly shown in phantom to sequentially isolate particular components of the assembly, with FIGS. 5A and B illustrating an adjusting mode of the assembly and FIG. 5C illustrating a locking mode of the assembly.
FIGS. 6A–C are schematic views of a pivot assembly of a second embodiment of the ratchet wrench of this invention, with portions of the assembly shown in phantom to sequentially isolate particular components of the assembly, with FIGS. 6A and B illustrating an adjusting mode of the assembly and FIG. 6C illustrating a locking mode of the assembly.

As shown in FIGS. 3 and 4, the connecting arms 39 of the handle 23 each have an opening 67 therein having a diameter D1 (FIG. 5A). The connecting arms 65 of the head 25 each have a corresponding opening 69 generally in coaxial alignment with the openings 67 of the handle connecting arms 39. In the illustrated embodiment, the openings 69 of the connecting arms 65 of the head 25 have a diameter D2 (FIG. 5B) larger than the openings 67 of the handle connecting arms 39 for reasons which will become apparent. The arms 39, 65 of the handle connecting end 37 and head connecting end 63 are pivotally connected by the locking mechanism 101 of the present invention. A flexible boot 71 is secured on the wrench 21 surrounding the handle and head connecting arms 39, 65 to enclose the connecting arms, the transmission 31 and the locking mechanism 101 while allowing pivoting movement of the head 25 relative to the handle 23 of the wrench 21.

The locking mechanism 101 for selective angular positioning of the head 25 of the wrench 21 relative to the handle 23 comprises a pivot assembly, generally indicated at 100, having a pivot pin 103 extending generally laterally relative to the wrench 21 in transverse relationship with the head and handle. The pin 103 extends through the connecting arms 39, 65 of the handle 23 and head 25 in the openings 67, 69 of the connecting arms in coaxial relationship therewith to define a pivot axis Xp about which the head of the wrench 21 is pivotable relative to the handle. The diameter of the pivot pin in the openings 67 of the handle connecting arms 39 is approximately the same as the diameter D1 of the handle openings to secure the pivot pin on the pivot axis Xp. The second gear 53 of the transmission 31 also has a central opening 73 for throughpassage of the pivot pin 03 for mounting the second gear on the pivot pin in coaxial relationship therewith for rotation relative to the pivot pin about the pivot axis Xp. Thus, it will be recognized that the rotation axis of the second gear 53 coincides with the pivot axis Xp of the pivot pin 103 so that when the head 25 is pivoted relative to the handle 23, the second gear remains stationary on the pivot axis while the third gear 55 moves about the periphery of the second gear and remains continually enmeshed with the second gear. This arrangement permits operation of the transmission 31 as described above with the head 25 positioned at various angular orientations relative to the handle 23.

As shown in FIGS. 3 and 4, the pivot pin 103 has opposing ends 105, 107.

Threaded fasteners 109, 113 extend through the boot 71 and are threadably received in a corresponding threaded bore 111, 115 extending axially within each end 105, 107 of the pivot pin 103 to secure the pivot pin in the wrench 21. The fastener 109 at one end 105 of the pivot pin 103 also extends through a knob 117 of the locking mechanism to secure the knob over the boot 71 in operative connection with the pivot pin 103 on the pivot axis Xp such that rotation of the knob relative to the boot effects rotation of the pin 103 on the pivot axis. In the illustrated embodiment, the knob 117 is movable between a first position (FIGS. 5A, 5B) corresponding to an adjusting mode of the locking mechanism 101 in which the head 25 of the wrench 21 is pivotable on the pivot axis relative to the handle 23 and a second position (FIG. 5C) corresponding to a locking mode of the locking mechanism in which the head of the wrench is locked against pivoting movement relative to the handle.

The other fastener 113 extends through a stop limit 119 of the locking mechanism 101 to secure the stop limit to the pivot pin 103 for conjoint rotation with the pivot pin and knob 117 in a recessed portion 121 of the corresponding connecting arm 39 of the handle 23. The stop limit 119 has opposed stop surfaces 123 that engage a shoulder 124 of the handle connecting arm 39, defined by the recessed portion 121, to limit rotation of the pivot pin 103 on the pivot axis Xp. The stop surfaces 123 are oriented angularly relative to each other to define the rotational travel of the pin 103 between the adjusting and locking modes of the locking mechanism 101. For example, the stop surfaces 123 of the illustrated embodiment are positioned at approximately a 90° angle relative to each other so that the pin 103 is rotatable through a 90° angle between the adjusting and locking modes of the locking mechanism 101. A ball 102 is seated in a resilient seat 104 affixed in one of the connecting arms 39 of the handle 23 such that the ball is biased outward from the seat. Recesses (not shown) corresponding to the adjusting and locking modes of the locking mechanism are disposed in the stop limit in opposed relationship with the ball for receiving the ball therein when the stop limit is in the adjusting mode or the locking mode of the locking mechanism to releasably secure the locking mechanism in the selected mode.

The remaining elements of the locking mechanism 101 are described with reference to one end 105 of the pivot pin and associated structure, it being understood that the opposite end 107 of the pivot pin and its associated structure are identical to that described. As shown in FIGS. 3 and 4, the pivot pin 103 has a pair of opposing flats 125 (broadly, cuts) extending axially inward from the end 105 of the pivot pin slightly beyond the opening 69 of the respective arm 65 of the head connecting end 63. The pin diameter is tapered at the inner end of each flat to define shoulders, the purpose of which will become apparent. Rounded portions 127 of the pivot pin 103 extend circumferentially between the flats 125. Opposing slots 129 (FIGS. 5A–C) of the locking mechanism 101 extend radially outward from the opening 67 of the handle connecting arm 39. The slots 129 are positioned such that in the adjusting mode of the locking mechanism 101 the flats 125 of the pivot pin 103 are generally in registry with the slots and in the locking mode the rounded portions 127 of the pivot pin 103 extending circumferentially between the flats are in registry with the slots.

Corresponding axially extending locking pins 131 (broadly, locking members) of the locking mechanism 101 are disposed in the openings 67, 69 of the connecting arms 39, 65 of the handle 23 and head 25 in spaced relationship with the pivot axis Xp. The locking pins 131 generally lie against the pivot pin 103 in the openings 67, 69 but are free from any fixed engagement with the pivot pin to permit rotation of the pivot pin in the openings relative to the locking pins between the adjusting and locking modes of the locking mechanism 101. The locking pins 131 each have a length substantially equal to the combined width of the connecting arms 39, 65 of the handle 23 and head 25 at the openings 67, 69 of the connecting arms. Thus, the pins 131 are axially positioned between the shoulders of the pivot pin formed at the inner ends of the flats and the knob to inhibit axial movement of the pins relative to the connecting arms 39, 65. The pins 131 at the other end of the pivot pin are secured against axial movement by the second gear of the transmission and the stop limit.

The pins 131 are sized in cross-section to seat securely in the slots 129 of the opening 67 in the handle connecting arm 39. As shown in FIG. 3A, the flats 125 and locking pins 131 are sized and arranged so that in the adjusting mode of the locking mechanism 101, the locking pins lie against the flats 125 of the pivot pin 103 and extend radially outward relative to the pivot axis Xp partially into the slots 129. Extending the pins 131 partially into the slots 129 in this manner maintains the position of the locking pins against rotation about the pivot axis Xp as the pivot pin 103 is rotated upon movement of the knob 117 between the adjusting mode and the locking mode of the locking mechanism 101 and while the head 25 is pivoted relative to the handle 23 in the adjusting mode of the locking mechanism. In the locking mode (FIG. 3C), the locking pins 131 are seated fully within the slots 129 and are retained in the slots by the rounded portions 127 of the pivot pin 103 extending between the flats 125.

The connecting arm 65 of the head 25 has slots 133 of the locking mechanism 101 extending radially outward from the opening 69. In the illustrated embodiment, there are 12 slots 133 spaced about the circumference of the opening 69 at approximately 30° intervals. Each slot 133 is sized for receiving one of the locking pins 131 therein in the locking mode of the locking mechanism 101. The number of slots 133 in the connecting arm 65 of the head 25 may vary without departing from the scope of this invention, as long as there are at least two slots where only one locking pin 131 is provided. As shown in FIG. 3B, the slots 133 are arranged in side-by-side arrangement about the circumference of the opening 69, with segments 135 of the connecting arm 65 of the head 25 extending between adjacent slots defining the diameter D2 of the opening. In the illustrated embodiment, the slots 133 are generally parabolic in shape and spaced sufficiently close so that the segments 135 between the slots are generally pointed. As described above, the outer diameter D2 of the opening 69 of the head connecting arm 65 is sized larger than the opening 67 of the handle connecting arm 39 and in the illustrated embodiment is sized slightly larger than the radial position of the locking pins 131 in the adjusting mode of the locking mechanism 101 so that the head 25 is free to pivot relative to the handle and locking pins about the pivot axis.

To adjust the angular orientation of the head 25 relative to the handle 23, the knob 117 is moved to its first position corresponding to the adjusting mode of the locking mechanism 101 so that the flats 125 at the end 105 of the pivot pin 103 are in registry with (i.e., they face toward) the slots 129 in the opening 67 of the handle connecting arm 39 in spaced relationship therewith. The locking pins 131 lie on the flats 125 and extend radially outward partially into the slots 129. The head 25 is pivoted relative to the handle 23 on the pivot axis Xp of the pivot pin 103 generally to a desired angular position of the head. As the head 25 pivots about the pivot axis Xp, the slots 133 surrounding the opening 69 of the connecting arm 65 of the head 25 sequentially come into registry with the slots 129 of the handle connecting arm opening 67. If the locking pins 131 fall or are otherwise jostled into the slots 133 as the head 25 is pivoted relative to the handle 23, further pivoting of the head causes the pins to move generally radially inward along the curved surfaces of the slots back against the flats 125. To lock the head 25 in the desired angular orientation relative to the handle 23, the knob 117 is moved to its second position corresponding to the locking mode of the locking mechanism 101. For example, in the illustrated embodiment, the knob 117 is moved through approximately a 90° rotation. Moving the knob 117 rotates the pivot pin 103 on the pivot axis Xp so that the rounded portions 127 of the pivot pin extending between the flats 125 are in registry with the slots 129 of the handle connecting arm 39. As the pivot pin 103 rotates on the pivot axis Xp, the locking pins 131 are pushed radially outward by the pivot pin into the slots 129 of the handle connecting arm 39 and the head connecting arm 65 and are secured in the slots by the rounded portions 127 of the pivot pin extending between the flats 125. The head 25 and handle 23 are thereby angularly interconnected in a fixed angular orientation of the head relative to the handle. Where the slots 133 of the head connecting arm 65 are not in full registry with the slots 129 of the handle connecting arm 39, pushing the locking pins 131 radially outward upon moving the knob 117 to its second position corresponding to the locking mode of the locking mechanism 101 will slightly shift the angular orientation of the head 25. For example, where the slots 133 are spaced at 30° intervals the head would be shifted no more than ±15°. Providing segments 135 between the slots 133 that come to a point inhibits the locking pins 131 from becoming stuck between the pivot pin 103 and the connecting arm 65 of the head 25 in the opening 69 of the head connecting arm and jamming the locking mechanism 101.

FIGS. 6A–C illustrate a second embodiment of a locking mechanism of the present invention similar to the first embodiment described above in which the pair of flats 125 at each end 105, 107 of the pivot pin 103 are replaced by four axially extending grooves 225 (broadly, cuts) at each end of the pivot pin 203. The grooves 225 are arcuate and are equally spaced about the pivot pin 203 (e.g., at 90° angles with respect to each other). Rounded portions 227 of the pivot pin extend between the grooves 225. There are also four locking pins 231 at each end of the pivot pin 203 in this second embodiment, corresponding to the four grooves 225 in the pivot pin. Likewise, there are four slots 229 extending radially outward from each opening 267 of the handle connecting arms 239. The rounded portions 227 of the pivot pin 203 extending between the grooves 225 each have an arcuate length greater than that of the slots 229 of the handle connecting arms 239 to secure the locking pins 231 in the slots in the locking mode of the locking mechanism. Providing four locking pins 231 requires less rotation of the switch 217 and pivot pin 203 relative to the handle to move the locking mechanism between its adjusting and locking modes.

It is to be understood that the head openings 69 and corresponding slots 133 may instead be disposed in the handle connecting arms 39, with the handle openings 67 and corresponding slots 129 disposed in the head connecting arms 65, without departing from the scope of this invention. Also, the above described pivoting head 25 arrangement may be used on various types of power driven tools or manually operated tools other than ratchet wrenches without departing from the scope of this invention.

In view of the above, it will be seen that the several objects of the invention are achieved and other advantageous results attained.

When introducing elements of the present invention or the preferred embodiment(s) thereof, the articles "a", "an", "the" and "said" arc intended to mean that there are one or more of the elements. The article "plurality" is intended to mean that there are two or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A wrench comprising:

a handle for gripping and holding the wrench;

a head; and a locking mechanism comprising a pivot assembly pivotally connecting the head to the handle such that the head is capable of pivoting movement relative to the handle about a pivot axis of the pivot assembly, the locking mechanism being configured to permit selective angular positioning of the head on the pivot axis of the pivot assembly relative to the handle, the locking mechanism being operable between an adjusting mode in which the head is pivotable relative to the handle for angularly positioning the head relative to the handle and a locking mode in which the head is locked in an angular position relative to the handle, the locking mechanism being rotatable about an axis transverse to the handle between the adjusting mode and locking mode of the locking mechanism, said rotation axis of the locking mechanism being coincident with the pivot axis of the head.

2. A wrench as set forth in claim 1 wherein the head and handle have respective openings generally in registry with each other in coaxial relationship on the pivot axis, the pivot assembly comprising a pivot pin extending transversely through the openings of the handle and head and defining the pivot axis, the pivot pin being rotatable on the pivot axis between the adjusting and locking modes of the locking mechanism, the locking mechanism further comprising a slot in one of the handle and head extending radially outward from the respective opening of said one of the handle and head, a plurality of slots in the other of the handle and head extending generally radially outward from the respective opening of said other of the handle and head and corresponding generally to the angular positions at which the head may be oriented relative to the handle, said plurality of slots being arranged for sequential registry with the slot extending from the opening of said one of the handle and head upon pivoting movement of the head relative to the handle, and a locking member disposed in the openings of the handle and head, the locking member being movable relative to the head and handle in response to rotation of the pivot pin between the adjusting mode and locking mode of the locking mechanism such that in the locking mode the locking member seats in the slot of the opening of said one of the handle and head and in a respective one of the plurality of slots of the opening of said other of the handle and head to secure the head against pivoting movement relative to the handle, in the adjusting mode the locking member being away from the plurality of slots of the opening of said other of the handle and head to permit pivoting movement of the head on the pivot axis relative to the handle.

3. A wrench as set forth in claim 2 wherein the opening of said other of the handle and head is sized larger than the opening of said one of the handle and head whereby in the adjusting mode of the locking mechanism the locking member extends radially outward a distance sufficient to extend partially into the slot of the opening of said one of the handle and head but insufficient to extend into one of the plurality of slots of the opening of said other of the handle and head whereby the locking member is free of any engagement with said other of the handle and head for pivoting the head relative to the handle about the pivot axis.

4. A wrench as set forth in claim 2 wherein the pivot pin has a cut extending axially therein generally in the openings of the handle and head, the locking member comprising a locking pin extending axially in the openings of the handle and head generally in contact with the pivot pin, the locking pin and cut of the pivot pin being arranged such that in the adjusting mode of the locking mechanism the locking pin contacts the cut and extends radially outward a distance insufficient to seat in one of the plurality of slots of the opening of said other of the handle and head whereby the head is pivotable relative to the handle, in the locking mode of the locking mechanism the locking pin contacting the pivot pin other than at the cut to extend radially outward a distance sufficient to seat in one of the plurality of slots of the opening of said other of the handle and head to lock the head against pivoting movement relative to the handle.

5. A wrench as set forth in claim 4 wherein the plurality of slots extending outward from the opening of said other of the handle and head are in generally side-by-side relationship about the circumference of said opening, said other of the handle and head having segments intermediate each of the plurality of slots and defining said opening, the segments being generally pointed to facilitate movement of the locking pin into one of the plurality of slots in the locking mode of the pivot assembly.

6. A wrench as set forth in claim 2 wherein there are twelve slots extending radially outward from the opening of said other of the handle and head, the slots being disposed circumferentially about the opening at approximately 30° intervals whereby the head may be angularly oriented relative to the handle generally at 30° increments.

7. A wrench as set forth in claim 4 wherein the cut is a flat.

8. A wrench as set forth in claim 4 wherein the cut is a generally arcuate groove.

9. A power wrench comprising:

a handle for gripping and holding the wrench;

a head pivotally connected to the handle for pivoting movement relative to the handle about a pivot axis;

the head and handle having respective openings generally in registry with each other in coaxial relationship on the pivot axis;

a locking mechanism comprising a pivot assembly pivotally connecting the head to the handle, the locking mechanism being configured to permit selective angular positioning of the head relative to the handle on the pivot axis, the locking mechanism being operable between an adjusting mode in which the head is angularly positionable relative to the handle and a locking mode in which the head is locked in an angular orientation relative to the handle;

the pivot assembly comprising a pivot pin extending transversely through the openings of the handle and head and defining the pivot axis, the pivot pin being rotatable on the pivot axis between the adjusting and locking modes of the locking mechanism, the locking mechanism further comprising a slot in one of the handle and head extending radially outward from the respective opening of said one of the handle and head, a plurality of slots in the other of the handle and head extending generally radially outward from the respective opening of said other of the handle and head and corresponding generally to the angular positions at which the head may be oriented relative to the handle, said plurality of slots being arranged for sequential registry with the slot extending from the opening of said one of the handle and head upon pivoting movement of the head relative to the handle, and a locking member disposed in the openings of the handle and head, the locking member being movable relative to the head and handle in response to rotation of the pivot pin between the adjusting mode and locking mode such that in the locking mode of the locking mechanism the locking member seats in the slot of the opening of said one of the handle and head and in a respective one of the plurality of slots of the opening of said other of the handle and head to secure the head against pivoting movement relative to the handle, in the adjusting mode the locking member being away from the plurality of slots of the opening of said other of the handle and head to permit pivoting movement of the head on the pivot axis relative to the handle; and a motor for powering the wrench.

10. A power wrench as set forth in claim 9 wherein the motor is pneumatically driven.

* * * * *